US007341228B1

(12) United States Patent
Grosaman et al.

(10) Patent No.: US 7,341,228 B1
(45) Date of Patent: Mar. 11, 2008

(54) FURNITURE FRAME BRACKET

(76) Inventors: Joel Grosaman, 6 Lorong 11/4D, 4600 Petaling Jaya, Selangor (MY); Howard Porter, 2-15E Faber Ria Condo, Jalan Desa Sentosa, Taman Desqa, Kuala Lumpur 58100 (MY)

( * ) Notice: Subject to any disclaimer, the term of this patent is extended or adjusted under 35 U.S.C. 154(b) by 208 days.

(21) Appl. No.: 10/852,078

(22) Filed: May 24, 2004

(51) Int. Cl.
*F16M 11/16* (2006.01)

(52) U.S. Cl. ..... 248/188; 297/440.1; 297/447.4

(58) Field of Classification Search ..... 297/440.1, 297/447.4; 248/188, 188.1, 188.9, 301, 501
See application file for complete search history.

(56) References Cited

U.S. PATENT DOCUMENTS 3,329,383 A * 7/1967 Pilliod et al. ..... 248/188
4,846,079 A * 7/1989 Ajax ..... 108/156
4,904,022 A * 2/1990 Morozzi ..... 297/440.1
4,911,390 A * 3/1990 Flick ..... 248/168
5,377,780 A * 1/1995 Dunaway ..... 182/185.1

* cited by examiner

*Primary Examiner*—Amy J. Sterling
(74) *Attorney, Agent, or Firm*—Jacobson and Johnson

(57) ABSTRACT

A furniture frame and a furniture frame bracket wherein the furniture frame bracket comprises a bracket base, a first side member extending from the bracket base and a second side member extending from the bracket base in which the side members each include an extension located thereon wherein the side members and the extensions of the side members coact with the bracket base to wrap the bracket around a portion of a furniture frame, and a leg extending from the base for supporting a linkage between a first section and a second section of a furniture frame.

20 Claims, 5 Drawing Sheets

FURNITURE FRAME BRACKET

FIELD OF THE INVENTION

This invention relates to furniture frames, and more specifically to a furniture frame having a bracket mechanism for supporting a linkage between a first section and a second section of the furniture frame such as a backrest section and a seat section of the furniture frame.

CROSS REFERENCE TO RELATED APPLICATIONS

None

STATEMENT REGARDING FEDERALLY SPONSORED RESEARCH OR DEVELOPMENT

None

REFERENCE TO A MICROFICHE APPENDIX

None

BACKGROUND OF THE INVENTION

Furniture frames that are convertible between a bed position and a couch position are known in the art. Use of convertible furniture frames allow users to maximize the use of a limited living space such as that of a studio or a small apartment by reducing the space dedicated for the furniture. That is, instead of requiring a space in the apartment dedicated solely for the user's bed and another space in the apartment dedicated solely for the user's couch or sofa, the use of the convertible furniture frame allow the user to eliminate one of the aforementioned dedicated furniture spaces thereby providing the user with increased living space.

The assembly of the aforementioned convertible furniture frames normally includes at least one but usually two linkages between a first section of the furniture frame and a second section of the furniture frame such as a backrest section and a seat section. The aforementioned linkage normally occurs at the sides of the backrest section and the seat section of the furniture frame and is traditionally connected by just a pin or bolt extending through the sides of the backrest section and the seat section. More specifically, in linking the sides of the backrest section to the seat section, the pin or bolt normally extends through one of the sides of the backrest section first and then through an elongated slot located on the side of the seat section, the elongated slot allowing for the horizontal displacement of the seat section for the conversion of the furniture frame between and the bed position and the couch position. A securing member such as a bolt is then attached to a free end of the pin or bolt to maintain the linkage.

Although the above prior art convertible furniture frames work for their intended purpose, due to the fact that the linkage between the backrest section and the seat section of the furniture frame is mainly supported by the side members of the backrest section and the seat section, prolong and/or substantial use of the prior art convertible furniture frames can often weaken the linkage of the furniture frame to a point where the linkage is broken due to potential cracking of the sidewalls of the furniture frame. The aforementioned is especially true around the area where the elongated slot of the seat section is located.

The present invention solves the above problem by providing for a furniture frame having a furniture frame bracket for further supporting the linkage between the sides of the backrest section and the seat section of the furniture frame so as to distribute the forces that are directed on the linkages between the backrest section and the seat section of the furniture frame to reduce the potential for breakage of the linkage.

SUMMARY OF THE INVENTION

The present invention is a furniture frame and a furniture frame bracket. The furniture frame includes a backrest section having a first side and a second side, a seat section having a first side and a second side and at least one furniture frame bracket comprising a bracket base, a first side member extending from the bracket base and a second side member extending from the bracket base. The side members of the bracket each include an extension located thereon wherein the side members and the extensions of the side members coact with the bracket base to wrap the furniture frame bracket around a portion of the furniture frame. The furniture frame bracket further includes a leg extending from the bracket base for supporting a linkage between the backrest section and the seat section of the furniture frame.

DESCRIPTION OF THE DRAWINGS

Figure 1:
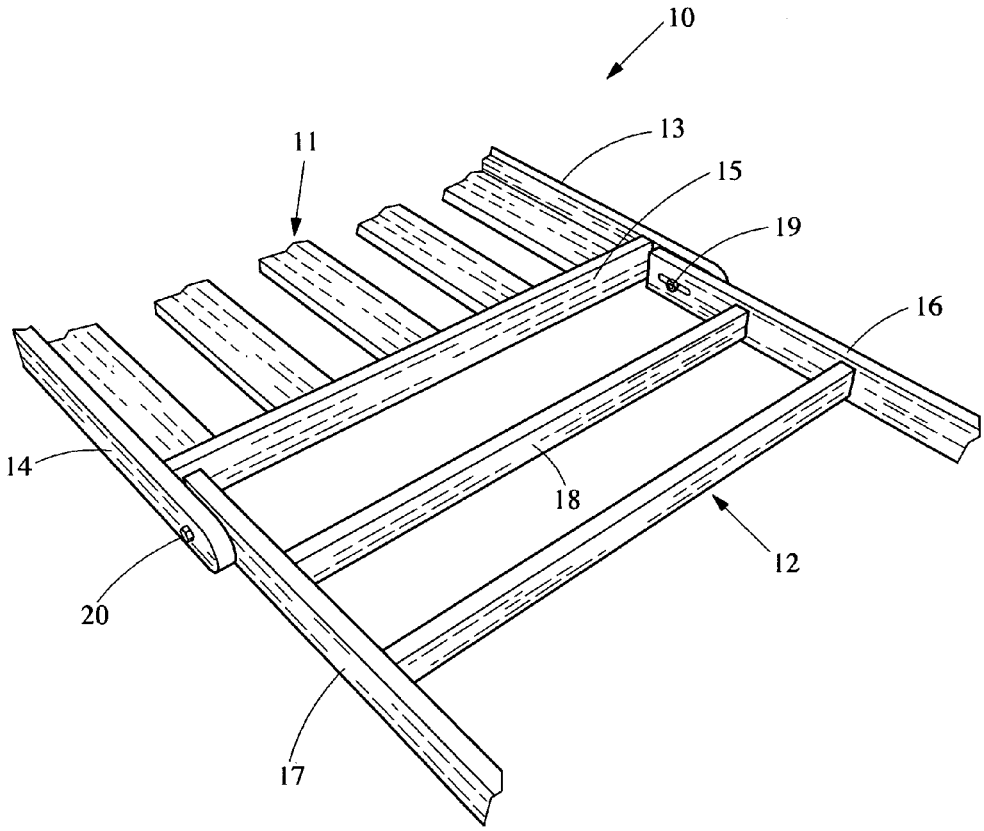
FIG. 1 (Prior Art)
FIG. 1 is a partial perspective view showing a prior art furniture frame.

Referring to FIG. 1, FIG. 1 is a partial perspective view showing a prior art furniture frame 10 that is convertible between a bed position and a couch position. Furniture frame 10 comprises a backrest section 11 and a seat section 12. As shown in FIG. 1, the backrest section 11 includes a first side 13, a second side 14 and a cross member 15 linking the first side 13 of the backrest section 11 to the second side 14 of the backrest section 11. The seat section 12 includes a first side 16, a second side 17 and a cross member 18 linking the first side 16 of the seat section 12 to the second side 17 of the seat section 12.

Located on the sides of the backrest section 11 and the seat section 12 is a first pin 19 linking the first side 13 of the backrest section 11 to the first side 16 of the seat section 12 and a second pin 20 linking the second side 14 of the backrest section 11 to the second side 17 of the seat section 12. Although not clearly shown, in order to maintain the linkage between the backrest section 11 and the seat section 12, a nut (not shown) can be secured to a free end of the first pin 19 and a free end of the second pin 20 to prevent withdrawal of the pins 19 and 20.

Figure 2:
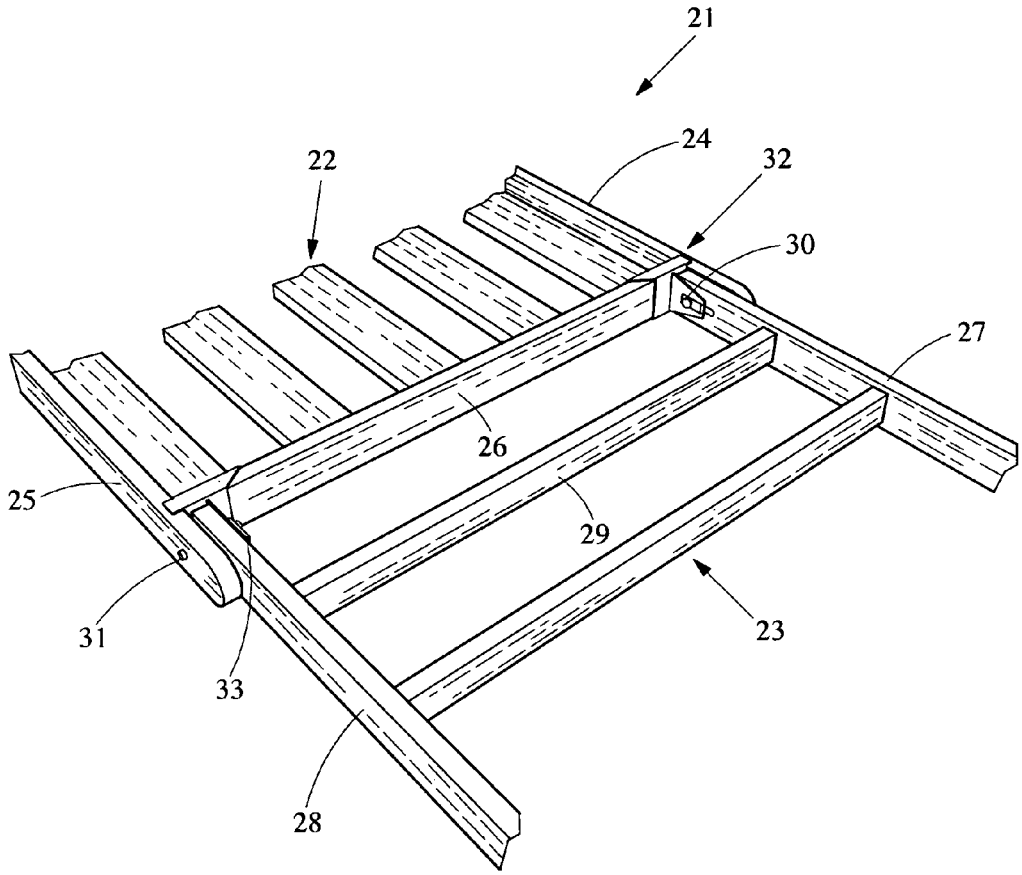
FIG. 2 is a partial perspective view of a furniture frame of the present invention.

Referring to FIG. 2, FIG. 2 is a partial perspective view showing a furniture frame 21 of the present invention. Furniture frame 21 is similar to the furniture frame 10 of FIG. 1 as furniture frame 21 also comprises a backrest section 22 having a first side 24, a second side 25, a cross member 26 linking the first side 24 of the backrest section 22 to the second side 25 of the backrest section 22 and a seat section 23 having a first side 27, a second side 28 and a cross member 29 linking the first side 27 of the seat section 23 to the second side 28 of the seat section 23. Located on the sides of the backrest section 22 and the seat section 23 is a first pin 30 linking the first side 24 of the backrest section 22 to the first side 27 of the seat section 23 and a second pin 31 linking the second side 25 of the backrest section 22 to the second side 28 of the seat section 23.

However, unlike the furniture frame of FIG. 1, Furniture frame 21 further includes a first furniture frame bracket 32 for further supporting the linkage between the first sides 24 and 27 of the backrest section 22 and the seat section 23 and a second furniture frame bracket 33 for supporting the linkage between the second sides 25 and 28 of the backrest section 22 and the seat section 23 by further distributing the forces that are directed on the linkages between the backrest section 22 and the seat section 23 of the furniture frame 21 so as to reduce the potential for breakage of the aforementioned linkage. Although furniture frame brackets 32 and 33 are shown secured to the cross panel member 26 of the backrest section 22, furniture frame brackets 32 and 33 can alternatively be secured to the cross panel member 29 of the seat section 23.

Figure 3:
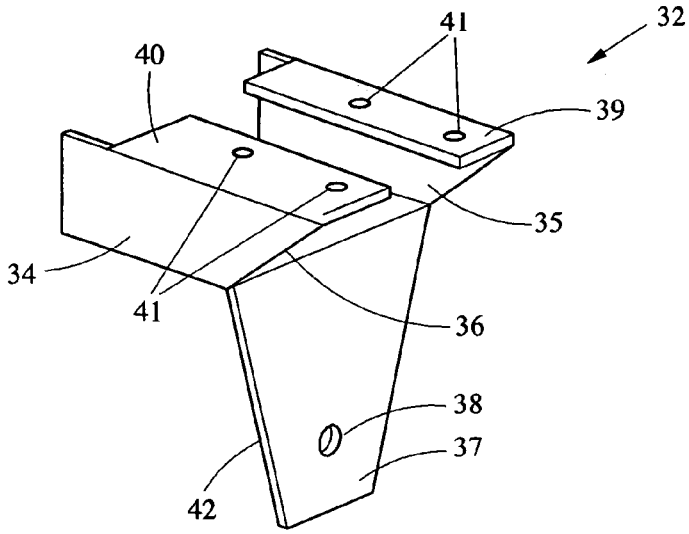
FIG. 3 shows a perspective view of the first furniture frame bracket of FIG. 2.
Figure 4:
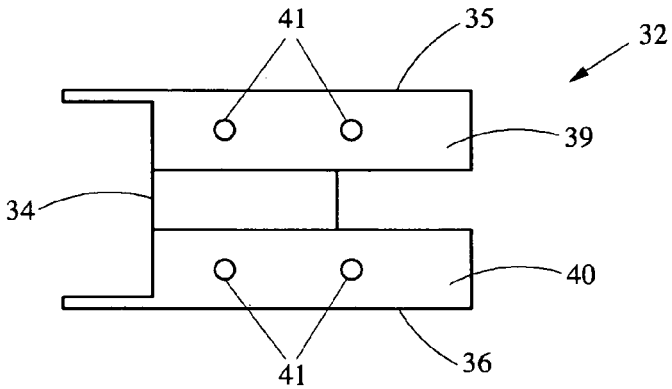
FIG. 4 shows a top view of the first furniture frame bracket of FIG. 2.
Figure 5:
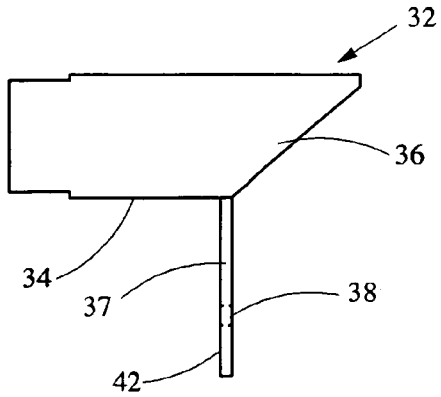
FIG. 5 shows a side view of the first furniture frame bracket of FIG. 2.

Referring to FIGS. 3, 4, and 5, FIG. 3 shows a perspective view, FIG. 4 shows a top view and FIG. 5 shows a side view of the first furniture frame bracket 32 of FIG. 2. Although first furniture frame bracket 32 will be further described, it is noted that the second furniture frame bracket 33 will have similar corresponding parts that are described for first furniture frame bracket 32.

As shown in FIGS. 3, 4, and 5, furniture frame bracket 32 comprises a bracket base 34 having a first side member 35 extending from bracket base 34 and a second side member 36 extending from bracket base 34, the side members 35 and 36 coacting with the bracket base 34 to engage a portion of a furniture frame 21. Referring to FIGS. 3 and 4, each of the side members 35 and 36 of furniture frame bracket 32 include an extension 39 and 40 stemming therefrom, the side members 35 and 36 and the extensions 39 and 40 of the side members 35 and 36 coacting with the bracket base 34 to wrap the furniture frame bracket 32 around a portion of furniture frame 21.

Although furniture frame bracket 32 can be secured to the furniture frame 21 in various ways such as by the use of an adhesive and/or by a frictional fit, FIG. 3 shows furniture frame bracket 32 having multiple attachment member guides 41 located on the extensions 39 and 40 for guiding attachment members such as nails or a bolts therethrough for the securement of furniture frame bracket 32 to the surface of furniture frame 21. Although FIGS. 3 and 4 show furniture frame bracket 32 having multiple attachment member guides 41, it is noted that alternative embodiments of the furniture frame bracket of the present invention can include as few as one attachment member guide.

Referring to FIGS. 3 and 5, also extending from bracket base 34 is a leg 37 for supporting a linkage between the backrest section 22 and the seat section 23 of furniture frame 21. Leg 37 includes a surface 42 which cooperate with the first side 24 of the backrest section 22 to sandwich the first side of the seat section 23 therebetween. In regards to the leg 37 of furniture frame bracket 32, although leg 37 can be position at various angles with respect to the bracket base 34 of furniture frame bracket 32, leg 37 is preferably position perpendicular to the bracket base 34. Referring to FIGS. 3 and 5, note that furniture frame bracket 32 also includes an orifice 38 located on the leg 37 of the bracket 32 for the extension of a protruding member therethrough.

Figure 6:
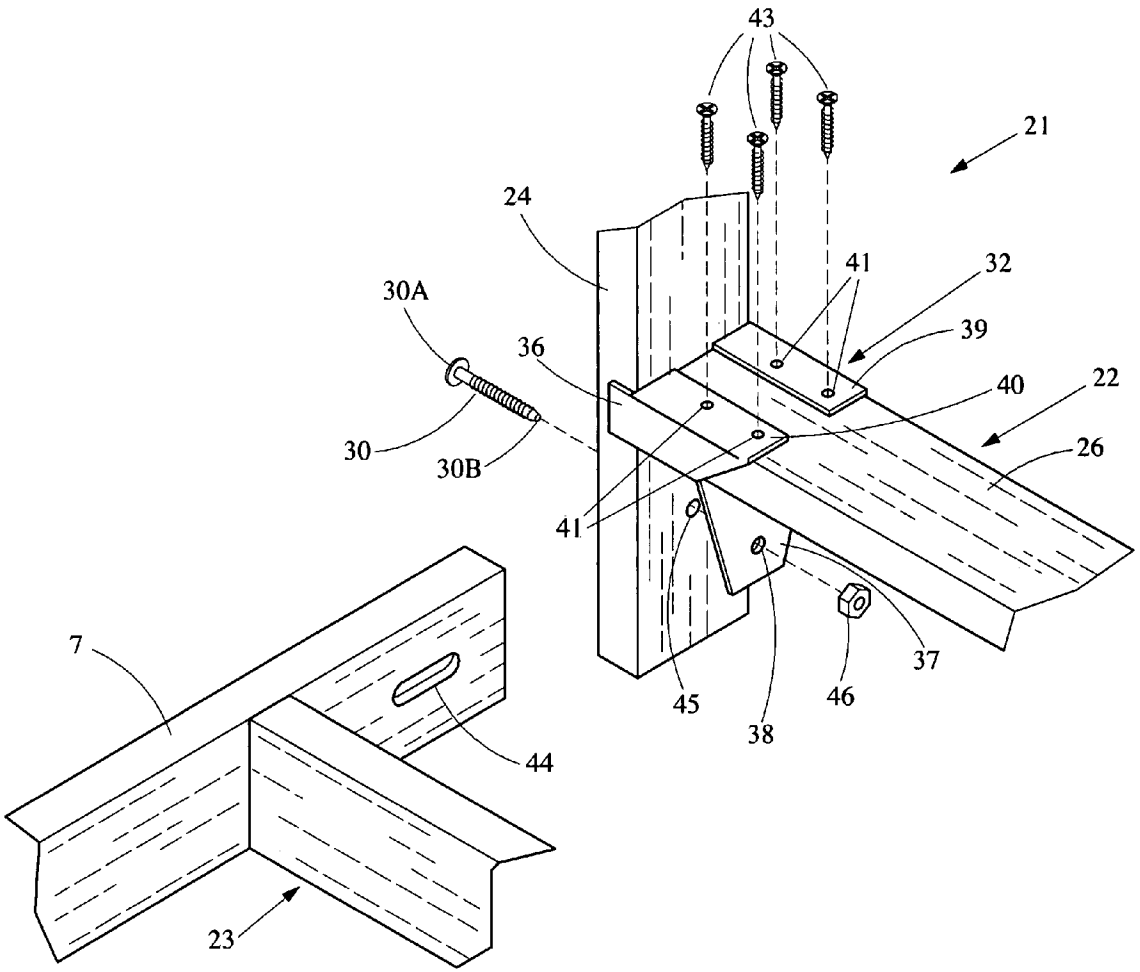
FIG. 6 is a partial exploded view showing the assembly of the first furniture frame bracket of FIG. 2 to the furniture frame.

FIG. 6 is a partial exploded view showing the assembly of furniture frame bracket 32 to furniture frame 21. In the assembly of furniture frame bracket 32 to furniture frame 21, the side members 35 and 36 and the extensions 39 and 40 of the side members 35 and 36 coact with the bracket base 34 (shown in FIGS. 3 and 4) to wrap furniture frame bracket 32 around the cross panel member 26. Furniture frame bracket 32 is then fixed to the cross panel member 26 of furniture frame 21 by the use of an attachment member comprising a plurality of screws 43, which as shown in FIG. 6, is directed through furniture frame bracket 32 by a plurality of attachment member guides 41.

It is noted that although plurality of screws 43 are used in the embodiment of FIG. 6 for the securement of furniture frame bracket 32 to furniture frame 21, as few as one screw can be used to secure first furniture frame bracket 32 to furniture frame 21. It is further noted that attachment members including but not limited to nail(s), nut(s) & bolt(s), or an adhesive can also be used to secure furniture frame bracket 32 to furniture frame 21.

Once furniture frame bracket 32 is secured to cross panel member 26, a portion of the first side 27 of the seat section 23 having a slot 44 located therein is sandwichly positioned between the first side 24 of backrest section 22 and the leg 37 of furniture frame bracket 32. The first side 24 of the backrest section 22 is then connected to the first side 27 of the seat section 23 and further supported by the leg 37 by the use of a first protruding member comprising a pin 30 having a head 30A and a free end 30B.

In further regards to FIG. 6, although FIG. 6 shows the first side 24 of the backrest section 22, the first side 27 of the seat section 23, and the orifice 38 of bracket 32 being linked by the extension of the free end 30B of pin 30 first through an access guide 45 located on the first side 24 of the backrest section 22, then through the slot 44 of the first side 27 of the seat section 23, and finally, through the orifice 38 of leg 37, it is noted that in the embodiment of FIG. 6, the free end 30B of pin 30 alternatively can extend first through the orifice 38 of bracket 32, then through the slot 44 of the first side 27 of the seat section 23, and finally through access guide 45 of first side 24 of backrest portion 22.

In further regards to the above, in order to maintain the linkage between the backrest section 22 and the seat section 23 of the furniture frame 21, a locking member such as a nut 46 can be secured to the free end 30B of the pin 30 to prevent withdrawal of pin 30.

Figure 7:
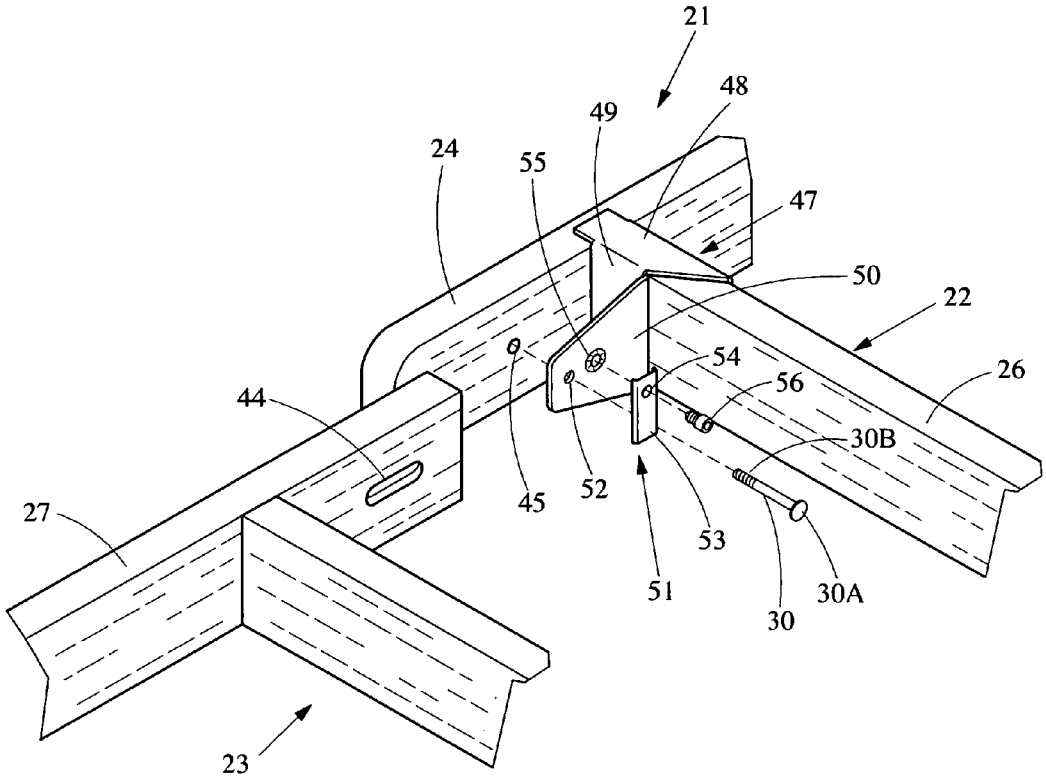
FIG. 7 is a partial exploded view showing the assembly of an alternative embodiment of a furniture frame bracket of the present invention to the furniture frame.

Referring to FIG. 7, FIG. 7 is a partial exploded view showing the assembly of an alternative embodiment of a furniture frame bracket 47 of the present invention to furniture frame 21. It is noted that furniture frame bracket 47 comprises similar parts to the furniture frame bracket 32 of FIGS. 2-6 except that furniture frame bracket 47 includes a pivotable stop 51 located on the leg 50 of the furniture frame bracket 47, pivotable stop 51 having a U-shaped channel 53 mateable with the head 30A of pin 30. Although pivotable stop 51 can be secured to the leg 50 of furniture frame bracket 47 by a variety of means, FIG. 7 shows pivotable stop 51 being secured to leg 50 by an attaching member 56 extending through an access 54 located on pivotable stop 51 and a receptor site 55 located on leg 50.

A feature of stop 51 is that stop 51 is pivotable from an unlock position to a lock position and vice versa wherein stop 51 engages the head 30A of pin 30 in the lock position to prevent withdrawal of the pin 30 from orifice 52 of furniture frame bracket 47. As such, the assembly of furniture frame bracket 47 to furniture frame 21 will be similar to the above assembly of furniture frame bracket 32 to furniture frame 21 previously described and shown in FIG. 6. A benefit of the use of stop 51 is that the linkage between the backrest section 22 and the seat section 23 of furniture frame 21 can be maintained without the use of a locking member such as the nut 46 shown in FIG. 6.

However, unlike furniture frame bracket 32 in which it is preferred that the first side 24 of the backrest section 22, the first side 27 of the seat section 23, and the orifice 38 of bracket 47 are linked by the extension of the free end 30B of pin 30 first through an access guide 45 located on the first side 24 of the backrest section 22, then through the slot 44 of the first side 27 of the seat section 23, and finally, through the orifice 38 of leg 37, in the assembly of furniture frame bracket 47 to furniture frame 21, in order to use the novel pin locking feature of the stop 51, the free end 30B of pin 30 extends first through the orifice 52 of bracket 47, then through the slot 44 of the first side 27 of the seat section 23, and finally through access guide 45 of first side 24 of backrest portion 22 while the stop 51 is in the unlocked position. Once pin 30 is in place, which is defined by the head 30A of pin 30 engaging leg 50, stop 51 is then pivoted from the unlock position to the lock position so that stop 51 engages the head 30A of pin 30 thereby preventing withdrawal of the pin 30 from the orifice 52.

Referring to FIGS. 6 and 7, again, it is noted that use of furniture frame bracket 32 and 47 supports the linkage between the backrest section 22 and the seat section 23 by further distributing the forces that are directed on the linkages between the backrest section 22 and the seat section 23 to reduce the potential for breakage of the linkage.

We claim:

1. A furniture frame bracket comprising:

a one-piece bracket base;

a first side member extending from a side of said base at a substantially perpendicular angle to said base and a second side member extending at a substantially perpendicular angle to said base on an opposite side of said base, said first side member including an extension extending inwards from said first side member towards said second side member and said second side member including an extension extending inwards from said second side member towards said first side member, said side members and said extensions of said side members, said side members and said extensions of said side members coacting with said bracket base to engage a portion of a furniture frame; and a leg extending from said bracket base in a direction substantially perpendicular to said bracket base and transverse to said side members for supporting a linkage between a first section and a second section of said furniture frame.

2. The bracket of claim 1 wherein said leg includes a stop pivotable from an unlock position to a lock position and vice versa wherein said stop prevents the withdrawal of a protruding member from said bracket.

3. The bracket of claim 1 including at least one attachment member guide located on said bracket for guiding an attachment member therethrough for the securement of said bracket to the portion of said furniture frame.

4. The bracket of claim 1 wherein said leg extend from said bracket base in a direction perpendicular to said bracket base.

5. The bracket of claim 1 wherein said leg includes an orifice for the extension of a protruding member therethrough.

6. The bracket of claim 1 wherein said leg includes a surface which cooperate with a side of said first section to sandwich a side of said second section therebetween.

7. A furniture frame comprising:

a first section having a first side and a second side;

a second section having a first side and a second side;

a first one-piece furniture frame bracket comprising a bracket base, a first side member extending from a side of said base at a substantially perpendicular angle to said base and a second side member extending from at a substantially perpendicular angle to said base on an opposite side of said base, said first side member having an extension extending inwards from said first side member towards said second side member and said second side member having an extension extending inwards from said second side member towards said first side member wherein said side members and said extensions of said side members coact with said bracket base to wrap said bracket around a portion of a furniture frame, and a leg extending from said bracket base in a direction substantially perpendicular to said bracket base and transverse to said side members for supporting a linkage between a first section and a second section of said furniture frame; and a second one-piece furniture frame bracket comprising a bracket base, a first side member extending from said base at a substantially perpendicular angle to said base and a second side member extending from at a substantially perpendicular angle to said base on an opposite side of said base, said first side member having an extension extending inwards from said first side member towards said second side member and said second side member having an extension extending inwards from said second side member towards said first side member wherein said side members and said extensions of said side members coact with said bracket base to wrap said bracket around a further portion of the furniture frame, and a leg extending from said bracket base in a direction substantially perpendicular to said bracket base and transverse to said side members for supporting a linkage between said first section and said second section of said furniture frame.

8. The furniture frame of claim 7 including an orifice located on said leg of said first furniture frame bracket wherein said first side of said first section is connected to said first side of said second section through the engagement of a first protruding member located on said first side of said first section with a slot located on the first side of the second section and the orifice of said first furniture frame bracket.

9. The furniture frame of claim 8 including an orifice located on said leg of said second furniture frame bracket wherein said second side of said first section is connected to said second side of said second section through the engagement of a second protruding member located on said second side of said first section with a slot located on said second side of said second section and the orifice of said second furniture frame bracket.

10. The furniture frame of claim 9 including a stop located on said leg of said furniture frame bracket, said stop pivotable from an unlock position to a lock position and vice versa wherein said stop engages with a head of said protruding member in said lock position to prevent the withdrawal of said protruding member from said orifice.

11. The furniture frame of claim 7 wherein said leg of said first furniture frame bracket includes a surface which cooperate with said first side of said first section to sandwich said first side of said second section therebetween and said leg of said second furniture frame bracket includes a surface which cooperate with said second side of said second section to sandwich said second side of said second section therebetween.

12. The furniture frame of claim 7 wherein said furniture frame brackets are wrapped around a cross panel member located on said second section for linking said first section to said second section.

13. The furniture frame of claim 7 wherein said leg of said first furniture frame bracket extend from said bracket base in a direction perpendicular to said bracket base of said first furniture frame bracket and said leg of said second furniture frame bracket extend from said bracket base in a direction perpendicular to said bracket base of said second furniture frame bracket.

14. The furniture frame of claim 7 wherein said first section comprises a backrest section and said second section comprises a seat section.

15. The furniture frame of claim 9 wherein said first protruding member comprises a first pin having a head and a free end and said second protruding member comprises a second pin having a head and a free end.

16. The furniture frame of claim 9 including a guide located on said first side and a guide located on said second side of said first section for guiding said protruding member therethrough.

17. The furniture frame of claim 9 including a stop securable to said leg of said furniture frame bracket, said stop having a U-shaped channel mateable with a head of said protruding member for preventing the withdrawal of said protruding member from said orifice.

18. The furniture frame of claim 15 including a first nut engageable with said free end of said first pin and a second nut engageable with said free end of said second pin, said nuts for preventing the withdrawal of said pins from said orifices.

19. The furniture frame of claim 17 including an attaching member having a head and a free end wherein said free end of said attaching member extends through an access guide located on said stop and through a receiving slot located on said leg of said furniture frame bracket for the securement of said stop to said leg.

20. A furniture frame bracket comprising:

a one-piece bracket base;

a first side member extending from a side of said bracket base at a substantially perpendicular angle to said bracket base and a second side member extending at a substantially perpendicular angle to said bracket base on an opposite side of said bracket base, said side members coacting with said bracket base to engage at least three sides of a portion of a furniture frame; and a leg extending from said bracket base in a direction substantially perpendicular to said bracket base and transverse to said side members for supporting a linkage between a first section and a second section of said furniture frame, said leg having a stop pivotable from an unlock position to a lock position and vice versa wherein said stop prevents the withdrawal of a protruding member from said bracket.

* * * * *

UNITED STATES PATENT AND TRADEMARK OFFICE

CERTIFICATE OF CORRECTION

PATENT NO. : 7,341,228 B1
APPLICATION NO. : 10/852078
DATED : March 11, 2008
INVENTOR(S) : Joel Grossman and Howard Porter It is certified that error appears in the above-identified patent and that said Letters Patent is hereby corrected as shown below:

Title Page; item (12);

In the header of the first page of said Letters Patent, the spelling of the last name of the first inventor should be changed to:

-- Grossman -- et al.

Title Page; item (76); should read;

In the inventors section, line 1 of the first page of said Letters Patent,

Inventors: -- Grossman -- 6 Lorong 11/14D, 4600

Signed and Sealed this

Eighth Day of July, 2008

JON W. DUDAS
*Director of the United States Patent and Trademark Office*